US005195303A

United States Patent [19]

Tomanovits

[11] Patent Number: 5,195,303

[45] Date of Patent: Mar. 23, 1993

[54] APPARATUS FOR AUTOMATIC BAGGING OF COMPRESSED TOBACCO

[75] Inventor: John Tomanovits, Richmond, Va.

[73] Assignee: Philip Morris Incorporated, New York, N.Y.

[21] Appl. No.: 891,444

[22] Filed: May 29, 1992

[51] Int. Cl.[5] ..... B65B 43/14; B65B 43/28; B65B 43/16; B65B 43/30

[52] U.S. Cl. ..... 53/459; 53/572; 53/384.1

[58] Field of Search ..... 53/459, 571, 572, 384.1, 53/390, 468, 469, 284.7

[56] References Cited

U.S. PATENT DOCUMENTS

| | | | |
|---|---|---|---|
| 2,958,990 | 11/1960 | Kerker | 53/571 X |
| 3,490,195 | 1/1970 | Abramson | 53/572 X |
| 3,662,514 | 5/1972 | Goss | 53/390 X |
| 3,699,741 | 10/1972 | Norman | 53/571 X |
| 4,157,003 | 6/1979 | Kamphaus | 53/572 |
| 4,177,621 | 12/1979 | Powell, Jr. | 53/572 X |
| 4,203,269 | 5/1980 | Petersen | 53/572 X |
| 4,245,944 | 1/1981 | Van Ginkel et al. | 53/572 X |
| 4,981,009 | 1/1991 | Gianelli | 53/459 X |
| 5,056,299 | 10/1991 | Furukawa et al. | 53/571 |
| 5,142,840 | 9/1992 | Cappi et al. | 53/390 X |

*Primary Examiner*—Horace M. Culver
*Attorney, Agent, or Firm*—Brenda J. Panichi

[57] ABSTRACT

Apparatus for automatic bagging of compressed bricks of material such as tobacco. The apparatus is provided with a bag opening mechanism, a bag magazine for containing a plurality of bags, a reciprocating table which retracts away from the brick loading mechanism after the compressed brick has been loaded into the opened bag, and a tilt table for dropping the bagged brick onto a take-away conveyor.

24 Claims, 9 Drawing Sheets

FIG. 3a
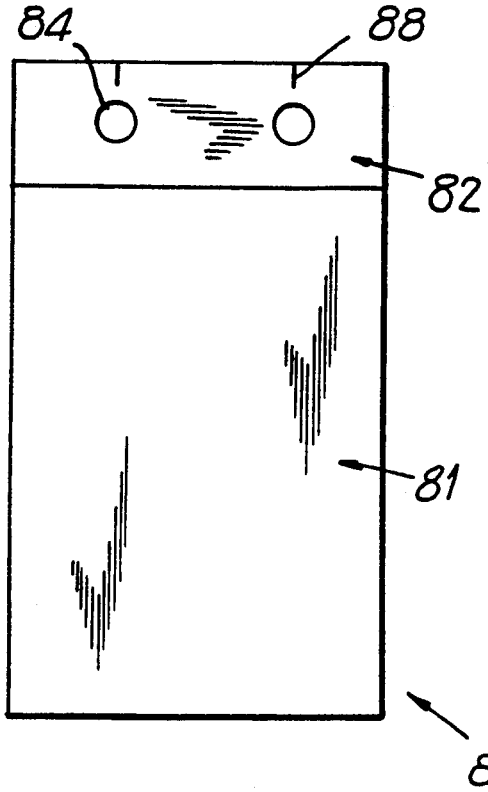
FIG. 3b
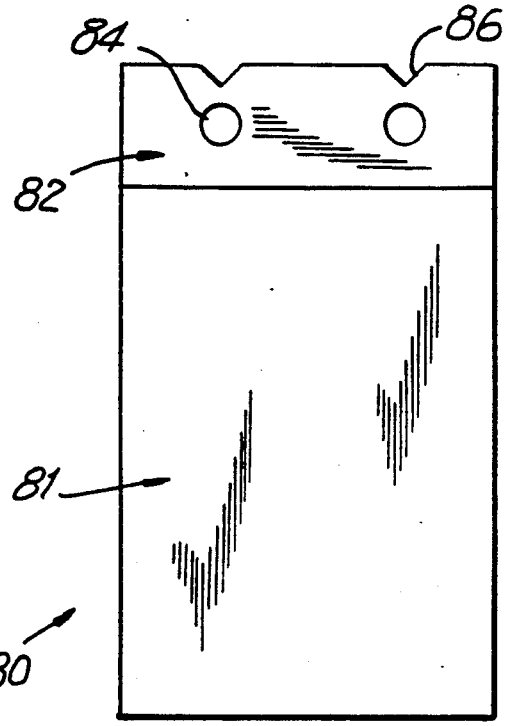
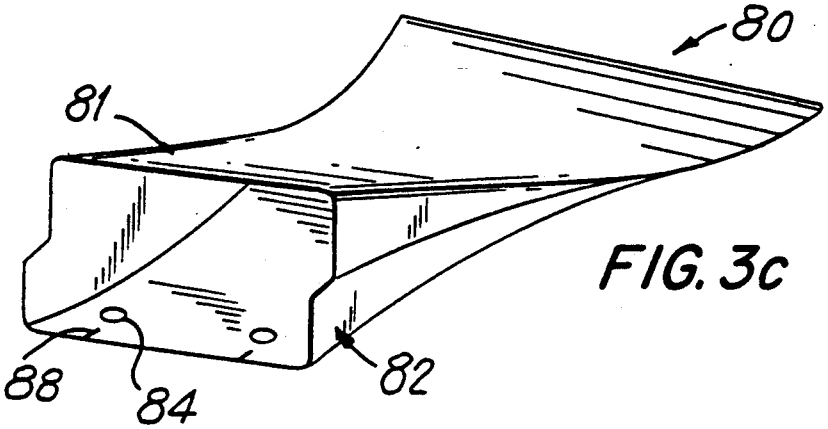
FIG. 3c

FIG. 8
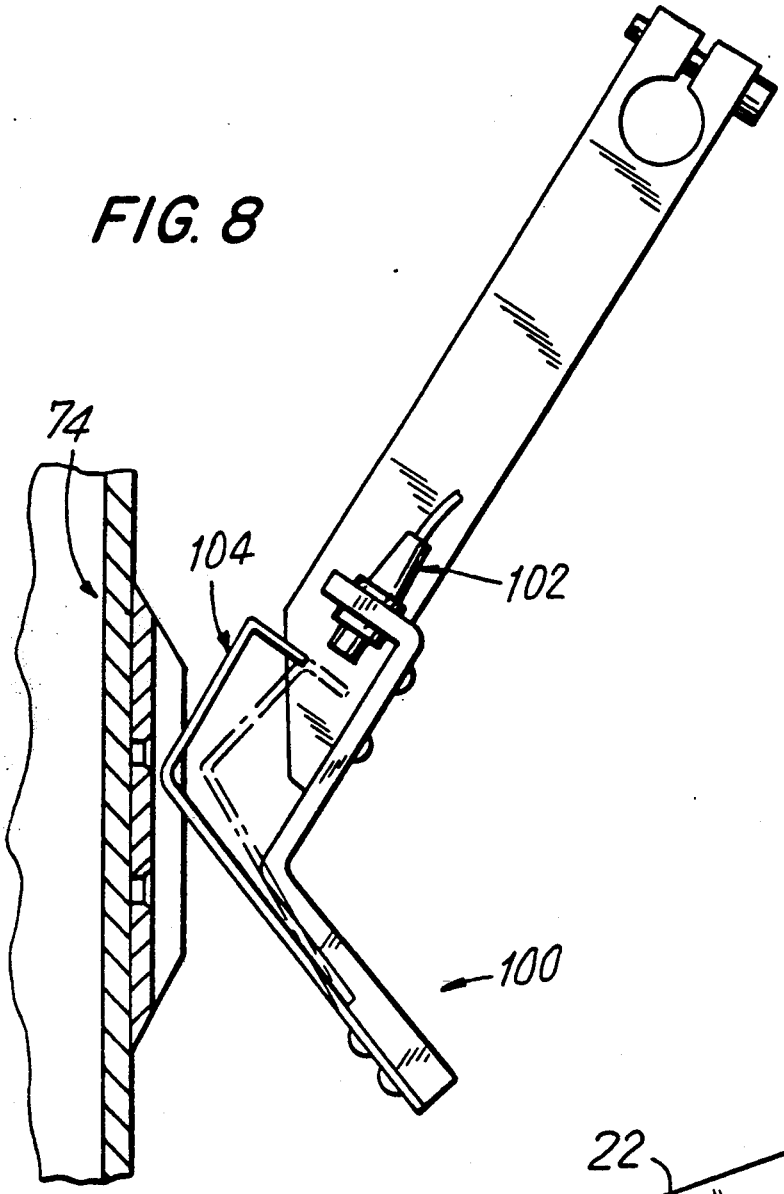
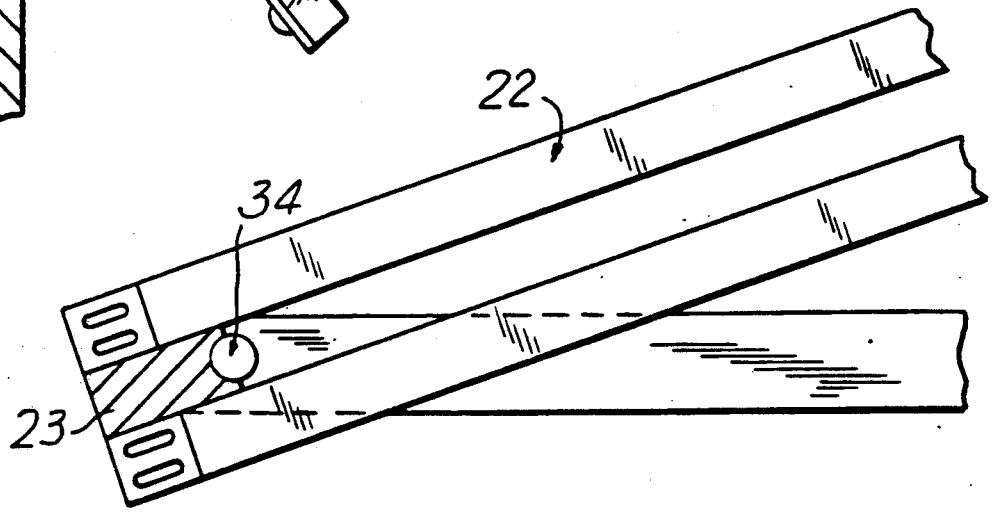
FIG. 9

APPARATUS FOR AUTOMATIC BAGGING OF COMPRESSED TOBACCO

BACKGROUND OF THE INVENTION

The present invention relates to bagging of compressed material, and particularly to apparatus for bagging compressed bricks of tobacco in a fully automated manner.

It is often necessary to provide a means for storing or transporting tobacco. It is generally known by those skilled in the art that for these purposes, cut tobacco may be compressed into a "brick" and then placed into a puncture-resistent plastic bag. In order to form the brick, the desired amount of tobacco may be placed into a compressor, where a ram condenses the tobacco into a brick which is a fraction of the original volume of tobacco placed into the compressor. The brick is pushed out of the compressor directly into a bag.

The known methods for inserting compressed bricks of tobacco into bags which are in use at present are often unsatisfactory. These methods are often slow and may also be inaccurate. For example, one such method requires an operator to place a bag by hand over the exit chute of the compressor, and once the bag is filled, remove it from the chute then fold and seal it by hand. Thus, the bagging process is slow and is dependent upon the speed of the operator. Seam consistency may also suffer.

Another method for bagging which is in use involves apparatus which raises the bag over the mouth of the exit chute of the compressor by vacuum suction. This method is often inaccurate as the locations on the bags at which the bags are be picked up by the vacuum suction may be inconsistent. Interference with the vacuum will also result in inaccurate placement of the bag or even in the bag being dropped.

Accordingly, a means is required for rapidly and accurately securing bricks of compressed tobacco in bags. A means for automatically bagging compressed bricks of tobacco is also required.

SUMMARY OF THE INVENTION

It is an object of the present invention to provide an efficient means for bagging compressed bricks of tobacco.

It is also an object of the present invention to provide a reliable means of placing a bag for receiving a compressed brick of tobacco such that the brick is securely and accurately fitted within the bag.

It is a further object of the present invention to provide a fully automatic means of bagging compressed bricks of tobacco.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout and in which:

FIG. 3*a* is a top view of one embodiment of a bag for use in the present invention;

FIG. 3*b* is a top view of an additional embodiment of a bag for use in the present invention;

FIG. 3*c* is a perspective view of the bag of FIG. 3*a* or FIG. 3*b* shown opened;

FIG. 8 is a top view of a portion of the apparatus of FIG. 6*a;*

FIG. 9 is a side view of a portion of the apparatus of FIG. 1;

DETAILED DESCRIPTION OF THE DRAWINGS

A preferred embodiment of the present invention is shown in FIGS. 1–11. Although the present invention is described in terms of its applicability in the tobacco processing industry, it will be recognized by those skilled in the art that the present invention has utility in other fields.

Figure 1:
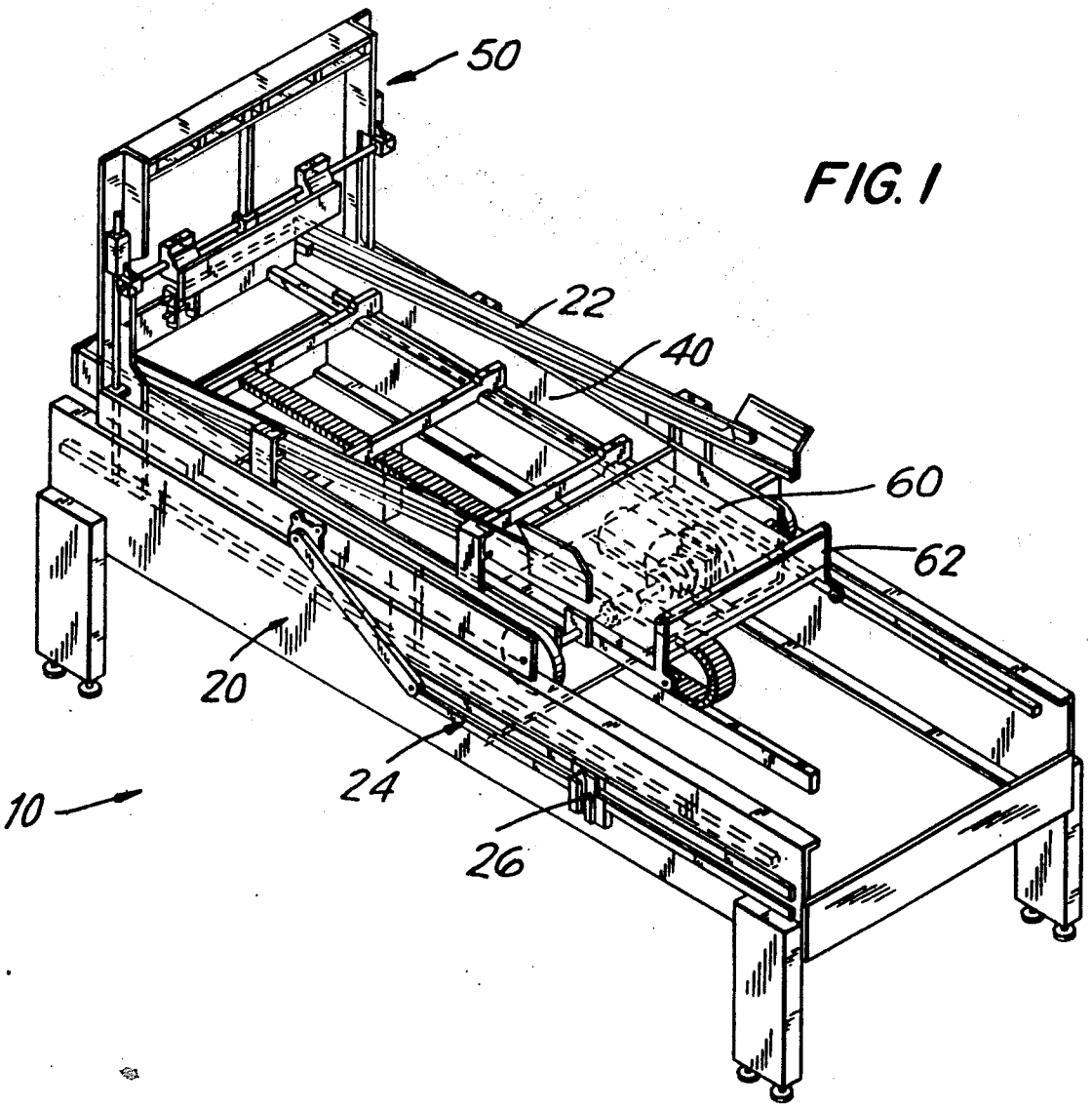
FIG. 1 is a perspective view of the apparatus of the present invention.

The automatic bagging apparatus of the present invention is shown in FIG. 1. Apparatus 10 is generally comprised of free standing main frame 20, which can be fastened to either or both the compressor which forms the loose tobacco into compressed bricks 5 and to the floor, bag magazine 30, reciprocating table 40, bag opening mechanism 50 and tilt table 60. Each of these components will be discussed in greater detail below.

Figure 2A:
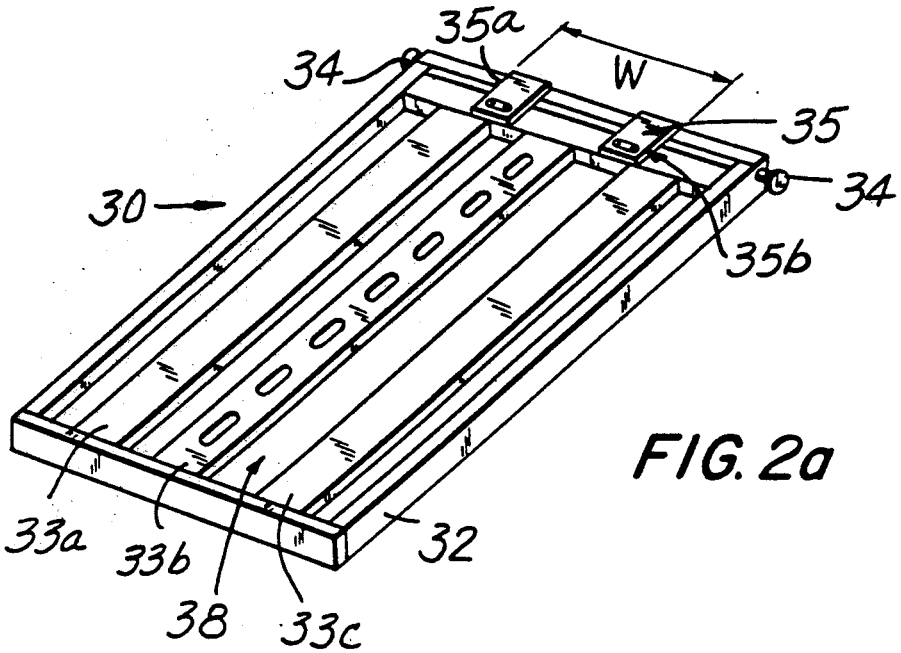
FIG. 2*a* is a top view of a portion of the apparatus of FIG. 1.

Bag magazine 30 is shown in FIG. 2*a*. Bag magazine 30 is detachable from the body of reciprocating table 40 of main frame 20 so that bags 80 may be more easily loaded into bag magazine 30. Bag magazine 30 may be provided with guiding rollers 34, shown more clearly in FIG. 2*c*, at the end of the bag magazine frame 32 which will be placed closest to bag opening mechanism 50 when bag magazine 30 is loaded into reciprocating table 40 of main frame 20. Guiding rollers 34 cooperate with bag magazine rails 22 (shown in FIG. 1) to properly position bag magazine 30 within main frame 20 to assure that bag opening mechanism 50 is positioned correctly with respect to bags 80. In order to place bag magazine 30 into reciprocating table 40, an operator tilts bag magazine 30 so that guiding rollers 34 roll within bag magazine rails 22. Bag magazine rails 22 are part of reciprocating table 40 and are angled upward relative to reciprocating table 40 for easy loading of bag magazine 30. Each bag magazine rail 22 is provided with an abutment 23 located at the foremost end of bag magazine rail 22, as shown in FIG. 9. Preferably, each abutment 23 has a concave radius of curvature to match the shape of the guiding roller 34. Thus, when guiding roller 34 contacts abutment 23, movement of bag magazine 30 is stopped and the operator drops bag magazine 30 down into the horizontal plane of reciprocating table 40.

As shown in FIG. 2a, bag magazine 30 is comprised of rectangularly shaped bag magazine frame 32 and surface 33 upon which bags 80 rest. Surface 33 is generally comprised of three parallel rails 33a–c with gaps 38 between each rail 33a–c. Gaps 38 allow any loose tobacco to fall through bag magazine 30 so as not to impair operation of apparatus 10. The bag magazine frame 32 may be made from metal. It has been found that ⅛" aluminum tubing is preferable because of its strength and light weight.

Figure 2B:
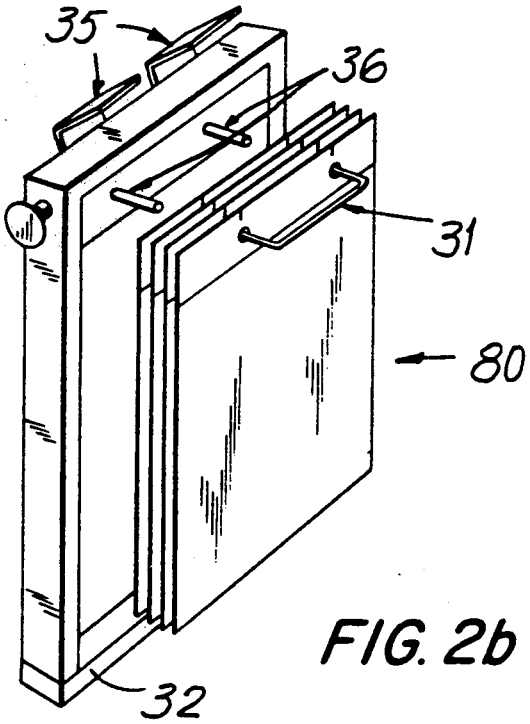
FIG. 2*b* is a perspective view of the apparatus of FIG. 2*a;*
Figure 2C:
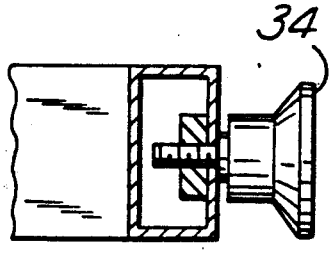
FIG. 2*c* is an enlarged view of a portion of FIG. 2*a;*

Bag magazine 30 is also provided with clips 35. Clips 35 are hand operated between the two positions indicated in FIGS. 2a and 2b. The width W shown in FIG. 2a between the outer edges 35a,b of the pair of clips 35 corresponds to the width of an opened bag 80. The width W is adjustable to allow for operation of the apparatus 10 with bags 80 of variable size. When clips 35 are in the upright position as shown in FIG. 2b, bags 80 can be loaded into bag magazine 30 over stud 36.

In order to load bags 80 into bag magazine 30, an operator removes bag magazine 30 from reciprocating table 40 and holds bag magazine 30 in a nearly vertical position, slightly inclined backward. Bags 80 are supplied stacked and held together by U-shaped wire wicket 31 shown in FIG. 2b. Each wicket 31 holds approximately 20 bags, the number of bags per wicket being limited by ease of operator handling. Bags 80 held on wire wicket 31 are picked up by the open ends of wire wicket 31 and inserted into the line-up holes of studs 36. Bags 80 are transferred from wicket 31 to studs 36. The now-empty wicket 31 is then withdrawn from studs 36. This procedure is repeated until bag magazine 30 is filled to its capacity of approximately 100 bags. After bags 80 have been loaded, clips 35 are snapped down over studs 36 as shown in FIG. 2a to retain bags 80 in bag magazine 30. Bag magazine 30 is then loaded into reciprocating table 40 by rolling guide rollers 34 into bag magazine rails 22 as described previously. After loaded bag magazine 30 has been put in place, apparatus 10 is ready to perform the bagging operation.

Preferred embodiments of bag 80 for use with the present invention are shown in FIGS. 3a–c. Bags 80 are generally rectangular and may be made with various dimensions to accommodate the size of brick 5 being bagged. Bags 80 are provided with holes 84, which are fitted over studs 36 of bag magazine 30. Bags 80 are generally comprised of an upper surface 81 and a lower surface 82, the upper surface 81 being shorter in length than the lower surface 82. The edges of bag 80 are sealed around their peripheries in the regions where upper surfaces 81 join lower surfaces 82. Bags 80 have a folded bottom that expands to a rectangular shape when a brick 5 is loaded into bag 80. Bags 80 are preferably made from a plastic material such as polyethylene.

Bags 80 may also be provided with slits 88 as shown in FIG. 3a or notches 86 as shown in FIG. 3b. Slits 88 and notches 86 are provided to ease the removability of bag 80 from bag magazine 30 after bag 80 has been filled with brick 5. As explained in greater below, the forward motion of reciprocating table 40 in a direction toward the end of main frame 20 at which the bricks 5 are loaded from the compressor into the bags 80 causes bag 80 to be torn away from studs 36 of bag magazine 30, around which holes 84 are seated. When provided with slit 88 or notch 86 as shown in FIG. 3a or 3b, bag 80 will stretch to a point where it will cleanly break away from stud 36. Thus, slits 88 or notches 86 also prevent extraneous pieces of plastic material from being torn out of bag 80 when bag 80 is removed from studs 36. If such extraneous pieces of plastic enter a bag containing product, the product inside may be contaminated.

Figure 4:
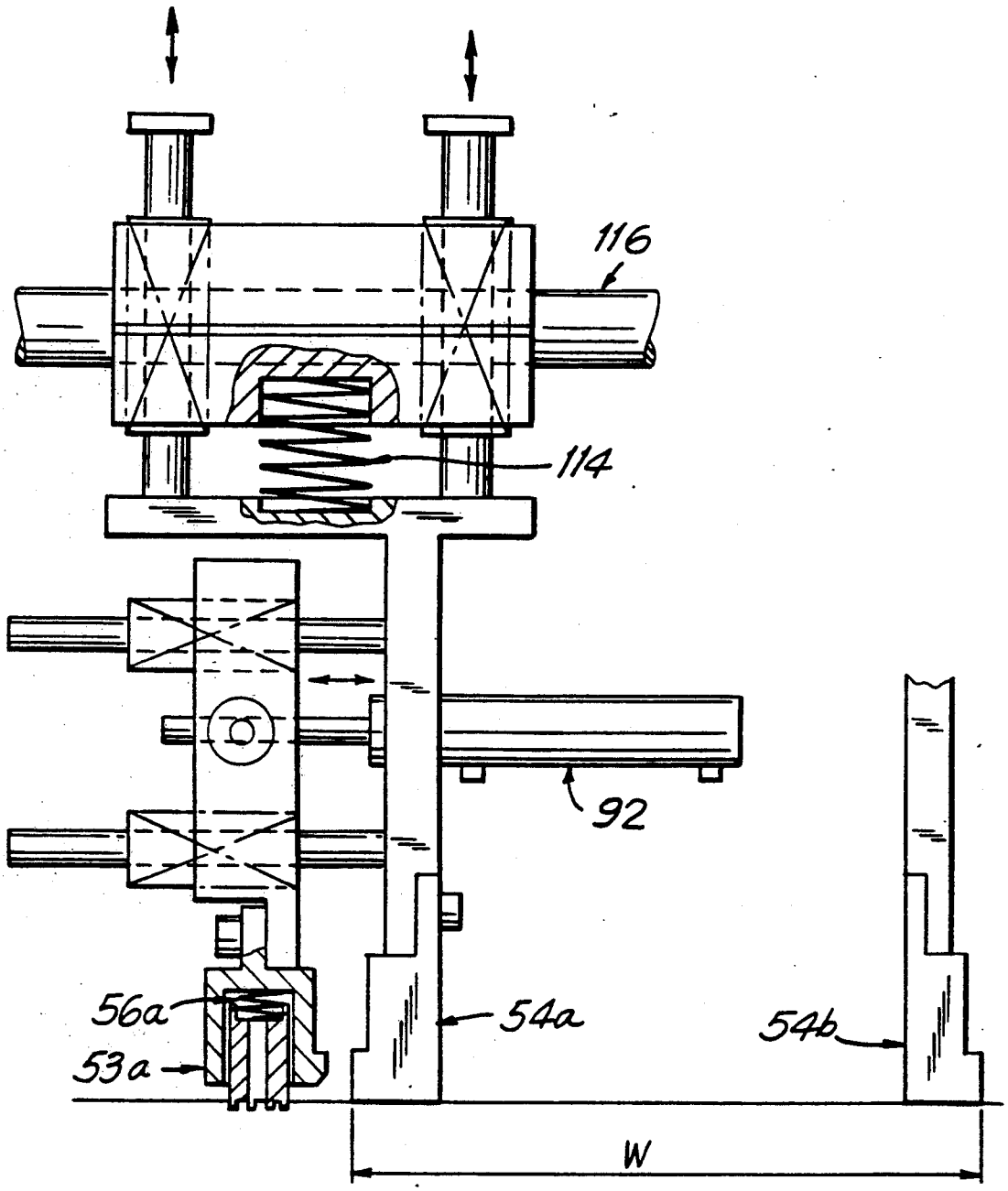
FIG. 4 is a front view of a portion of the apparatus of FIG. 1.
Figure 5A:
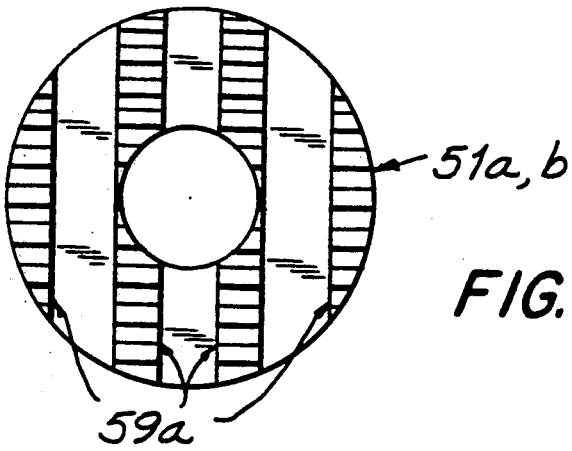
FIGS. 5*a–c* are end views of a portion of the apparatus shown in FIG. 4.
Figure 5B:
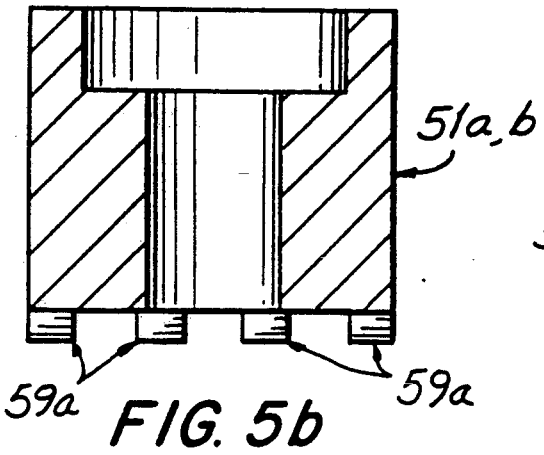
Figure 5C:
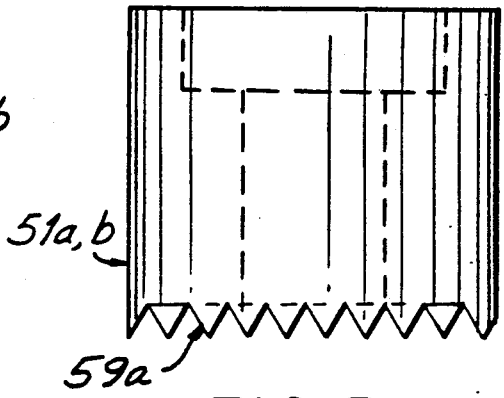
Figure 10:
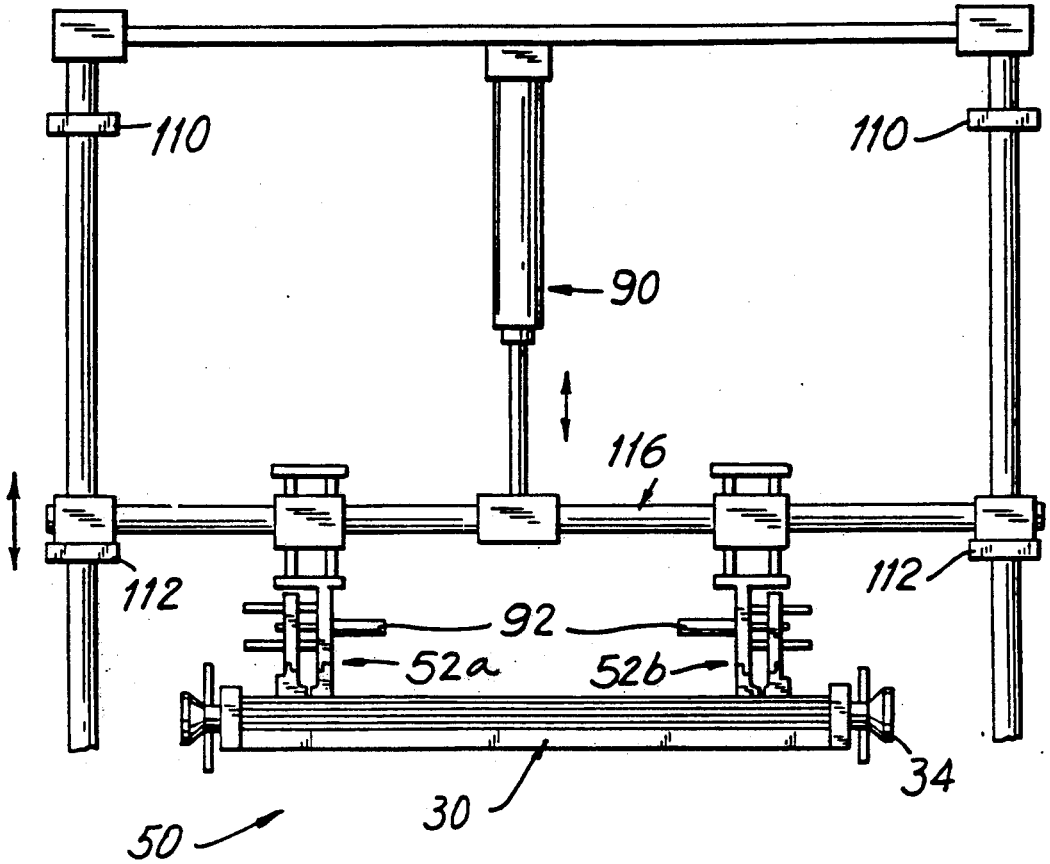
FIG. 10 is an enlarged view of a portion of the apparatus of FIG. 1.
Figure 11:
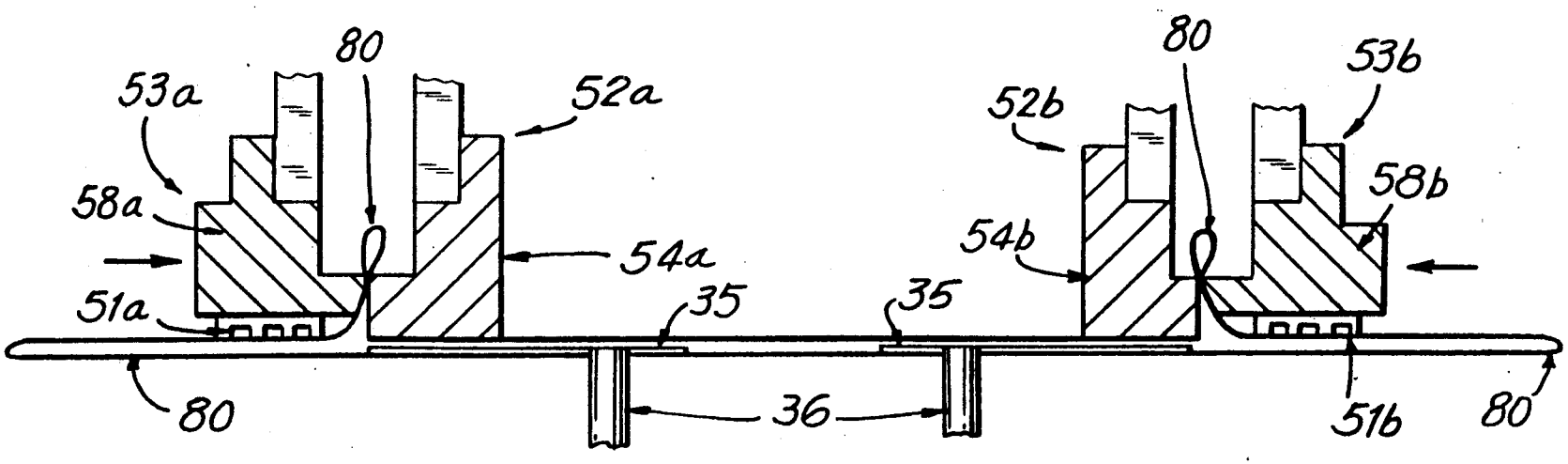
FIG. 11 is an enlarged view of a portion of the apparatus shown in FIG. 10.

As more clearly shown in FIGS. 4, 10 and 11, bag opening mechanism 50 includes first set of mated gripping jaws 52a and second set of mated gripping jaws 52b (not shown in FIG. 4) for gripping the topmost bag 80 in bag magazine 30. First set of mated gripping jaws 52a is comprised of first outer jaw assembly 53a and first inner jaw 54a. Second set of mated gripping jaws 52b is comprised of second outer jaw assembly 53b and second inner jaw 54b. The design of first and second sets of mated jaws 52a,b allows for accurate gripping of bag 80. The configuration of first set of mated gripping jaws 52a will be more clearly described as follows. Although the following description is given for first set of mated gripping jaws 52a, it will be understood that second set of mated gripping jaws 52b is similarly constructed.

First outer jaw assembly 53a is comprised of first biased foot 58a and first extensible foot 51a as shown in FIGS. 4 and 11. First extensible foot 51a is fitted within first biased foot 58a under first compression spring 56a. First extensible foot 51a is provided with teeth 59a shown in FIGS. 5a–c. Teeth 59a provide improved gripping of bag 80 as shown in FIG. 11.

First outer jaw assembly 53a is provided with first compression spring 56a in order to make first extensible foot 51a compressible in a vertical direction relative to first biased foot 58a. First extensible foot 51a is designed to be compressible in order to provide positive contact between first extensible foot 51a and the surface of bag 80 once first inner jaw 54a is fully resting on the surface of bag 80. Compression spring 114 allows the entire gripping assembly to move up and down relative to support shaft 116. This movement is smallest when bag magazine 30 is empty and largest when bag magazine 30 is full, as shown in FIG. 10.

The bagging operation will be described as follows. As shown in FIG. 10, support shaft 116, which supports first and second sets of mated gripping jaws 52a and 52b, is lowered against lower stops 112 by first air cylinder 90 (shown in FIG. 10). First and second extensible feet 51a,b come into contact with topmost layer 81 of topmost bag 80 in bag magazine 30, thereby collapsing first and second compression springs 56a,b until first and second inner jaws 54a,b contact bag 80 as shown in FIG. 11. When bag magazine 30 is full, bag opening apparatus compression spring 114 prevents first and second sets of mated gripping jaws 52a,b from moving downward before support shaft 116 reaches lower stops 112. Bag opening apparatus differences in height that may exist between first set of mated gripping jaws 52a and second set of mated gripping jaws 52b. At this stage, second air cylinder 92 is in its fully extended position whereby first and second sets of mated gripping jaws 52a,b are positioned so as to have the maximum amount of distance between them.

First outer jaw 53a of first set of mated gripping jaws 52a is movable in a lateral direction so as to be engageable with first inner jaw 54a, which remains stationary during the gripping operation. First outer jaw 53a is supported by first inner jaw 54a to permit the lateral movement, which is effected by second air cylinder 92, of first outer jaw 53a with respect to first inner jaw 54a. The spacing between first outer jaw 53a and first inner jaw 54a when first outer jaw 53a is in its outermost position (farthest from first inner jaw 54*a* ) is preferably set by the stroke length of first air cylinder 90.

As lower stops 112 are reached by support shaft 116, second air cylinder 92 retracts and first and second extensible feet 51*a,b* and stationary first and second inner jaws 54*a,b* gather and pinch the upper layer 81 of the topmost bag 80 in bag magazine 30, as shown in FIG. 11. The arrows shown in FIG. 11 indicate the inward movement of first outer jaw 53*a* relative to stationary first inner jaw 54*a* and the inward movement of second outer jaw 53*b* relative to stationary second inner jaw 54*b*.

Once bag 80 has been gripped as shown in FIG. 11, support shaft 116 is elevated against upper stops 110, thus opening bag 80 to a predetermined height. Thus, bags 80 are given the shape shown in FIG. 3*c*. Because the upper surface 81 of bag 80 is somewhat shorter than lower surface 82 of bag 80, first and second sets of mated jaws 52*a*, 52*b* may easily grip and raise upper surface 81 of bag 80 while lower surface 82 of bag 80 is pulled tightly against the outer edges of clips 35. This line always forms the lower level and the width of the bag opening. Thus, brick 5 can be loaded into bag 80 as shown in FIG. 6*a*.

The top width of the bag opening is determined by the dimension W between the gripping surfaces of first and second inner jaws 54*a,b* as shown in FIG. 4. This distance W is the same distance between the outer edges of the latches 35 of bag magazine 30 as shown in FIG. 2*a*.

Figure 6A:
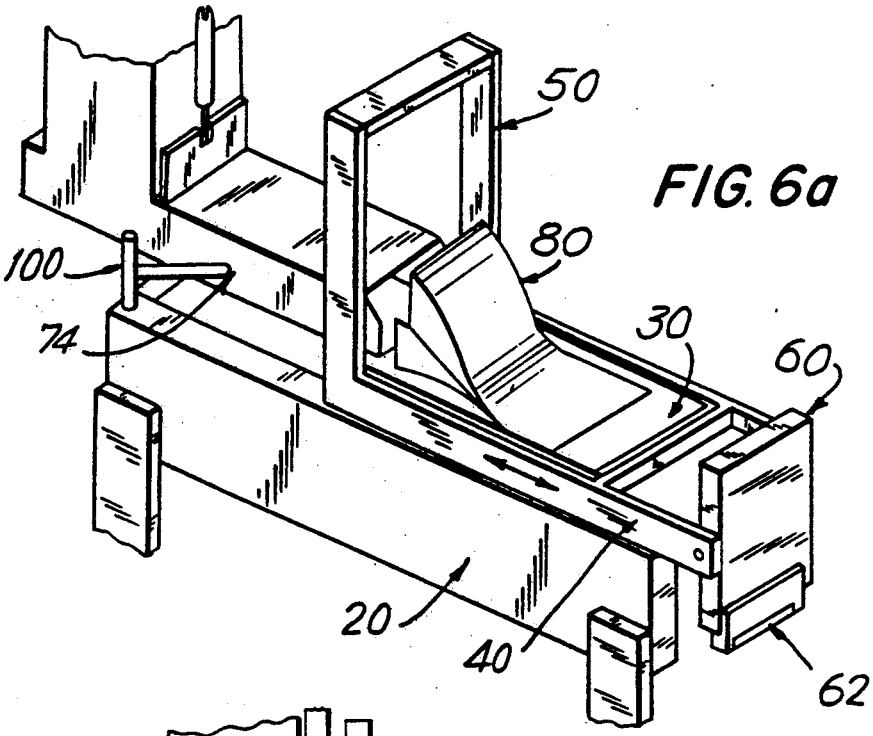
FIGS. 6a–c are a series of views of the apparatus of FIG. 1 showing the apparatus at different points in the sequence of the bagging operation.
Figure 6B:
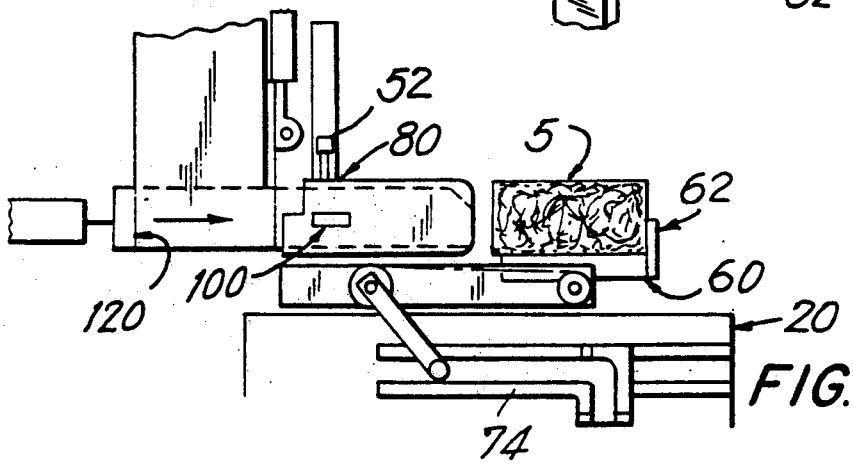
Figure 6:
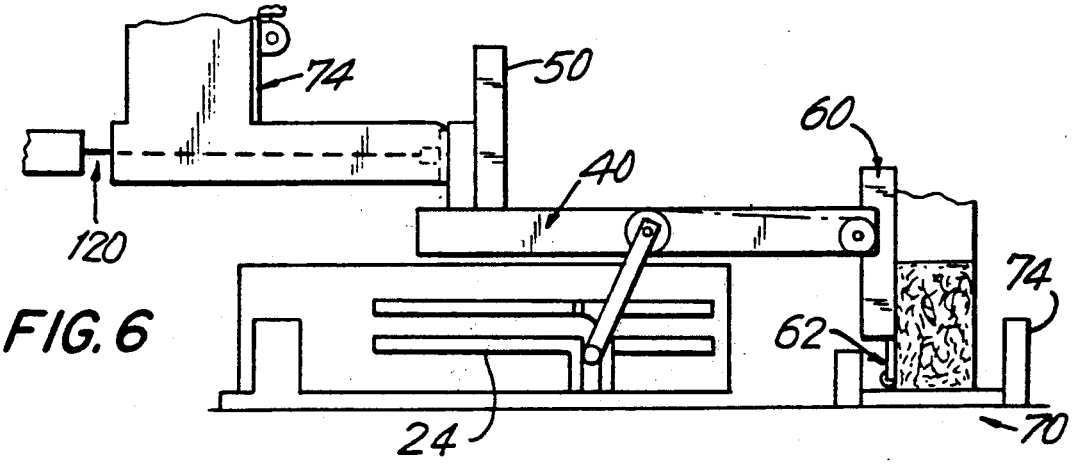

With bag 80 gripped at two locations by first and second sets of mated griping jaws 52*a,b* as shown in FIG. 11 and bag 80 opened as shown in FIGS. 3*c* and 6*a*, reciprocating table 40 shifts forward to place opened bag 80 over the mouth of compressor chute 74, as shown in FIG. 6*b*. It is to be appreciated that in this position, the positive gripping of the top mouth portion of the bag 80 by the mated gripping jaws 52*a,b* has urged a lower mouth portion of the bag 80 against the outer edges 35*a,b* of the clips 35 such that the opened mouth portion of the bag 80 may substantially conform with the mouth of the chute 74 with minimal clearance. Preferably, the outer edges 35*a,b* of the clips 35 and the location of the raised mated gripping jaws 52*a,b* will be mutually arranged so that the opened mouth portion of the bag 80 will just clear the chute 74, preferably in the range of an inch or less all about the perimeter of the chute 74, or more preferably, one-eighth of an inch or less. Such clearances facilitate a full and snug fit between the compressed tobacco 5 and bag 80 while minimizing the size of bag 80. The ends of chute 74 are inwardly bevelled so as to urge open the collapsed bag 80 as reciprocating table 40 moves forward. After chute 74 reaches the end of bag 80, first and second sets of mated gripping jaws 52*a,b*, release bag 80.

To align tilt table 60 with end of discharge chute 74, reciprocating table 40 travels approximately 3–4 additional inches forward toward the compressor. Additional forward movement of bag 80 is prevented by the position of chute 74 against the rearward portion of bag 80. Therefore, bag 80 is ripped free studs 36 of bag magazine 30. At this point in the bagging operation, tilt table 60 is in its horizontal position.

With bag 80 positioned completely over the mouth of chute 74, ram 120, which is a part of the compressor, pushes brick 5 into bag 80. Brick 5, which comes out of the chute 74 in a tightly compressed state, expands slightly to fill up the volume of bag 80. The pushing action of the ram 120 pushes brick 5 against the bottom of bag 80. As brick 5 is expelled from discharge chute 74, it fills bag 80, transferring filled bag 80 to tilt table 60. When brick 5 has cleared chute 74, reciprocating table 40 moves backward. A servo motor may be used to drive gear racks which control the movement of reciprocating table 40.

Figure 7:
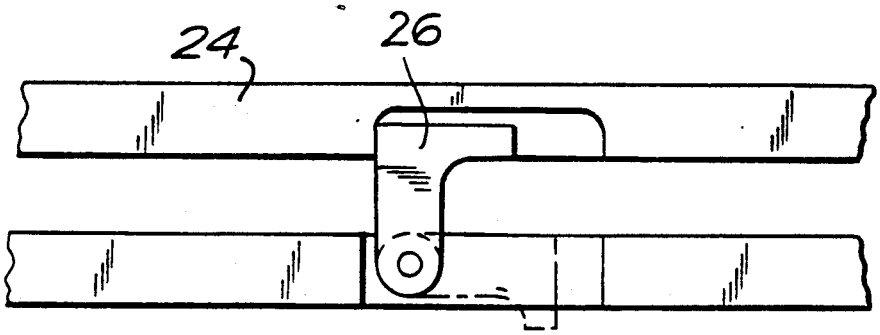
FIG. 7 is an enlarged view of a portion of the apparatus of FIG. 1.

Tilt table guide rails 24 are provided with latch 26 as shown in FIG. 7. Latch 26 flips up to allow reciprocating table 40 to follow a path which results in tilt table 60 being moved from the position shown in FIG. 6*b* to the position shown in FIG. 6*c*. As shown in FIG. 6*c*, hinged leaf 62 of tilt table 60 is then released, thereby dropping bagged brick 5 onto conveyor 70 which transports bagged brick 5 to further work stations. Conveyor 70 may also be provided with stop bar 74 as shown in FIG. 6*c*. Stop bar 74 prevents the momentum of bagged brick 5 which results when bagged brick 5 is flipped onto conveyor 70 from tilt table 60 from causing bagged brick 5 from being knocked away from conveyor 70. After bagged brick 5 has been deposited and taken away, another bag 80 is opened and loaded onto discharge chute 74. Tilt table 60 also moves into a horizontal position.

Latch 26 is also movable to the position shown by dashed lines in FIG. 7. When in this position, reciprocating table 40 moves in a straight path so that bag magazine 30 may be loaded into reciprocating table 40.

As shown in FIG. 8, apparatus 10 may be provided with sensors 100*a,b*. Sensors 100*a,b* are comprised of proximity switches 102*a,b* and angled springs 104*a,b*. Sensors 100*a,b* are fixed relative to compressor chute 74 as shown in FIGS. 6*a* and 6*b*. When bag 80 is in the opened position and moving toward the mouth of compressor chute 74, as shown in FIG. 6*a*, bag 80 pushes springs 104*a,b* into the sensing ranges of proximity switches 102*a,b*. The springs 104*a,b* then move as shown by the dashed lines in FIG. 8. When proximity switches 102*a,b* sense the movement of the opened bag 80 into the proper position, a brick 5 is pushed into bag 80. If bag 80 has not opened properly, springs 104*a,b* will not be moved into the sensing range of proximity switches 102*a,b*. If the proximity switches 102*a,b* do not sense the bag, no brick 5 is pushed from chute 74. Instead, first and second pairs of mated gripping jaws 52*a,b* return for a new bag. Springs 104*a,b* also hold opened bags 80 in place once bag 80 has been released from first and second sets of mated gripping jaws 52*a,b*. Empty bag magazine 30 is also indicated by opposing electric eyes (not shown) under and over bag magazine 30.

It will be apparent to those skilled in the art that the invention described herein can be practiced by other that the embodiments described above, which are presented for the purpose of illustration and not of limitation and are limited only by the claims which follow.

I claim:

1. Apparatus for bagging compressed bricks of material, the apparatus comprising:

a frame;

a first table;

means for movably mounting the first table to the frame such that the first table is movable within the frame between a first forward position and a second rearward position;

a magazine, the magazine being rectangular in shape for holding a plurality of bags for receiving the compressed bricks of material;

means for removably fitting the bag magazine within the first table such that the bag magazine is movable with the first table between the first forward position and the second rearward position;

a second table, the second table being adjacent to the magazine and being pivotally attached to the first table so that the second table is movable between a first horizontal position when the first table is in the first forward position and a second tilted position when the first table is in the second rearward position; and a bag opening mechanism, the bag opening mechanism being movable between a first upper position and a second lower position and being located above and attached to the first table such that the bag opening mechanism is engageable with the topmost bag of the plurality of bags held in the bag magazine when the first table with the bag magazine fitted within the first table is in the first forward position and the bag opening mechanism is in the second lowered position.

2. The apparatus as defined in claim 1 wherein compressed bricks of material are compressed bricks of tobacco.

3. The apparatus as defined in claim 1 wherein the bag opening mechanism is comprised of a first set of mated gripping jaws and a second set of mated gripping jaws in a spaced relationship.

4. The apparatus as defined in claim 3 wherein the first set of mated gripping jaws is comprised of a first outer jaw and a first inner jaw and the second set of mated gripping jaws is comprised of a second outer jaw and a second inner jaw.

5. The apparatus as defined in claim 4 wherein the first outer jaw is laterally movable to engage the first inner jaw thereby gripping a segment of the topmost bag of the plurality of bags held in the bag magazine between the first outer jaw and first inner jaw when the bag opening mechanism is in the second lowered position, and the second outer jaw is laterally movable to engage the second inner jaw, thereby gripping a segment of the topmost bag of the plurality of bags held in the bag magazine between the second outer jaw and second inner jaw when the bag opening mechanism is in the second lowered position, and both the first inner jaw and the second inner jaw are not movable in a lateral direction.

6. The apparatus as defined in claim 4 or 5 wherein the first outer jaw is further comprised of a first extensible foot and a first biased foot, the first extensible foot being fitted with the first biased foot and the second outer jaw is further comprised of a second extensible foot and a second biased foot, the second extensible foot being fitted within the second biased foot.

7. The apparatus as defined in claim 6 wherein each of the first outer jaw and the second outer jaw is provided with a spring whereby the first extensible foot is movable in a direction transverse to first biased foot and the second extensible foot is movable in a direction transverse to the second biased foot.

8. The apparatus as defined in claim 6 wherein each of the first extensible foot and the second extensible foot is provided with teeth for contacting the topmost bag in the bag magazine.

9. The apparatus as defined in claim 1 further comprising transport means whereby the bagged brick of material is transported from the apparatus.

10. The apparatus as defined in claim 1 wherein the means for movably mounting the first table to the frame is comprised of a first pair of separate guide rails mounted to the frame which receive a plurality of rollers attached to the first table whereby the rollers roll within the first pair of rails between the first forward position of the first table and the second rearward position of the first table.

11. The apparatus as defined in claim 1 further comprising means for moving the second table between the first horizontal position and the second tilted position.

12. The apparatus as defined in claim ? 1 wherein the means for moving the second table is comprised of a second pair of separate guide rails provided with a latch, the latch movable between a first latch position whereby the second table is in the first horizontal position and a second latch position whereby the second table is in the second tilted position.

13. The apparatus as defined in claim 1 wherein the bag magazine is comprised of a rectangular frame, a surface contained within the rectangular frame for holding the plurality of bags, a pair of studs protruding from the flat bed surface, and a pair of clips provided with an aperture, each of the clips being movable between an open position and a closed position such that when each of the clips is in the closed position, each of the apertures is fitted around each of the studs.

14. The apparatus as defined in claim 13 wherein each of the plurality of bags is provided with a paired holes whereby the bag is fitted over the studs.

15. The apparatus as defined in claim 14 wherein each of the plurality of bags is further provided with a pair of slits extending from an edge of the bag.

16. The apparatus as defined in claim 15 wherein each of the plurality of bags is further provided a pair of notches extending inwardly from an edge of the bag nearest to the holes.

17. The apparatus as defined in claim 1 wherein the means for removably fitting the bag magazine within the first table is a pair of bag magazine rails attached to each side of the first table, the bag magazine rails being upwardly angled relative to the first table.

18. The apparatus as defined in claim 17 wherein the bag magazine is provided with a pair of guide rollers which cooperate with the bag magazine rails in fitting the bag magazine within the first table.

19. The apparatus as defined in claim 4 wherein the first extensible foot is greater in length than the first biased foot and the second extensible foot is greater in length than the second biased foot.

20. The apparatus as defined in claim 1 wherein the second table is comprised of a base and a hinged leaf, the hinged leaf being disposed substantially perpendicular to the base when the second table is in the first upright position and being disposed substantially parallel to the base when the second table is in the second tilted position.

21. The apparatus as defined in claim 1 further comprising sensing means for sensing whether the bag opening mechanism has opened the topmost bag of the plurality of bags held in the bag magazine.

22. A method of bagging a material, the material being deliverable through a chute, the chute having a chute mouth, the method comprising the steps of:

opening a mouth portion of a bag into a configuration in substantial conformity with the chute mouth by locating a lower mouth portion of the bag adjacent spaced apart edges and moving a plurality of spaced apart grippers relative to the spaced apart edges while gripping a top mouth portion of the bag with the spaced part grippers so that the lower mouth portion of the bag is urged against the spaced apart edges, whereby the configuration is defined by the relative positions of the spaced apart edges and the spaced grippers upon conclusion of the relative movement;

urging the opened bag mouth about the chute mouth and along at least a portion of the chute by moving the spaced apart edges and spaced apart grippers relative to the chute, whereby the bag is deployed about the chute;

releasing said top mouth portion of the bag from the spaced grippers; and removing the deployed bag from the chute while discharging the material into the deployed bag.

23. The method as set forth in claim 22 wherein during the deploying step, the chute mouth urges apart top and bottom portions of the bag.

24. The method as set forth in claim 22 further comprising the step of releasably retaining the urged bag against the chute prior to the step of removing the bag from the chute.

* * * * *